US005967819A

United States Patent [19]

Okada

[11] Patent Number: 5,967,819

[45] Date of Patent: Oct. 19, 1999

[54] ELECTRIC JUNCTION BOX AND METHOD FOR MOUNTING A BUS BAR IN SAME

[75] Inventor: Kouichi Okada, Yokkaichi, Japan

[73] Assignee: Sumitomo Wiring Systems, Ltd., Mie, Japan

[21] Appl. No.: 08/810,411

[22] Filed: Mar. 4, 1997

[30] Foreign Application Priority Data

May 20, 1996 [JP] Japan ..... 8-124936

[51] Int. Cl.[6] ..... H01R 9/24

[52] U.S. Cl. ..... 439/212; 439/949

[58] Field of Search ..... 439/76.2, 212, 439/949, 746, 595, 594

[56] References Cited

U.S. PATENT DOCUMENTS

| | | | |
|---|---|---|---|
| 4,869,675 | 9/1989 | Ogawa | 439/76.2 OR |
| 4,952,753 | 8/1990 | Hayashi et al. . | |
| 5,000,693 | 3/1991 | Hatagishi et al. . | |
| 5,314,354 | 5/1994 | Nomura et al. . | |
| 5,322,445 | 6/1994 | Ozaki et al. | 439/949 X |
| 5,403,193 | 4/1995 | Ito et al. | 439/76.2 X |

FOREIGN PATENT DOCUMENTS 2 293 052 3/1996 United Kingdom .

*Primary Examiner*—Paula Bradley
*Assistant Examiner*—Daniel Wittels
*Attorney, Agent, or Firm*—Oliff & Berridge, PLC

[57] ABSTRACT

To reduce the number of components contained in an electric junction box, an electric junction box containing a bus bar therein includes a connecting area formed integrally on a portion of the bus bar while a complimentary connecting area provided on the lower case cooperates with the connecting area of the bus bar. The bus bar is arranged on the upper surface of the lower case with the connecting areas firmly fastened to each other, with the bus bar being directly fastened to the lower case. The upper cover is placed on and fastened to the lower case while the bus bar is connected to the lower case, thereby making the use of an upper case unnecessary.

12 Claims, 3 Drawing Sheets

ELECTRIC JUNCTION BOX AND METHOD FOR MOUNTING A BUS BAR IN SAME

BACKGROUND OF THE INVENTION

1. Field of the Invention

The present invention relates to an electric junction box which performs multipoint connection incorporating a bus bar, relay, fuse, electronic components, etc., thereby reducing cost and size by reducing the number of components.

2. Description of the Related Art

An electric junction box having heretofore been used in an automobile wire harness usually incorporates a bus bar, relay, fuse, and electronic parts therein. With the recent increased use of electric equipment to be mounted on an automobile, the number of these parts is increasing, which makes the equipment larger in size with an increasing trend of complicated structures thereof.

For example, with the electric junction box as shown in FIG. 4, a lower case 3 and an upper case 4 are incorporated, respectively, within a lower cover 1 and an upper cover 2 inside a box. A bus bar 5 is installed on an upper surface of the lower case 3, and the upper case 4 is arranged on an upper surface of the bus bar 5. The upper case 4 is lock fastened on the upper surface of the lower case 3. In addition, a housing area for a relay and fuse 6, etc. is provided for the upper case 4, and the upper cover 2 is provided in such a manner that the components are covered and fastened to the lower case 3 with the lower cover 1 being fastened to the lower case 3.

As mentioned above, the bus bar 5 is only placed on the upper surface of the lower case 3, and the upper case 4 is arranged therewith. A surrounding wall 4*a* of the upper case 4 is inserted externally around a surrounding wall 3*a* of the lower case 3, and a locked area formed with the surrounding walls 4*a* and 3*a* is fastened, so that the bus bar 5 is firmly held.

As mentioned above, the conventional electric junction box forms a multipart structure comprising a lower cover, lower case, upper case, upper cover and box. In addition, because the bus bar 5, fuse, relay, electronic components, etc. are mounted thereon, it requires a large number of components, increasing the number of assembly processes and making the cost higher. Furthermore, a larger number of components inevitably increases the weight and also the capacity.

SUMMARY OF THE INVENTION

The present invention was made in view of the above problems, and for decreasing the number of components. One objective of the present invention is to reduce the cost and the number of production processes, as well as making the electric junction box smaller in size and also lighter in weight.

In order to solve the above problem according to one aspect of the present invention, there is provided an electric junction box which incorporates a bus bar therein. The junction box includes a connecting area provided on a portion of the bus bar, and a complimentary connecting area provided on the lower case that detachably connects with the bus bar connecting area. The bus bar is arranged on the upper surface of the lower case with the connecting area surely fastened to the complimentary connected area, and the upper cover is placed on and fastened to the lower case with the bus bar attached thereto.

That is, conventionally a bus bar held and fastened between the lower case and the upper case is directly connected and fastened to the lower case, making it unnecessary to use the upper case which was conventionally required. Furthermore, when the bus bar is laminated and arranged via an insulation plate, by laminating a bus bar to the insulation plate, and, in turn, on the upper surface of lower case, the connecting area is provided on a top position of the bus bar and directly connected and fastened.

A lower cover may be mounted on the lower area of the lower case. That is, the lower case may be detachedly mounted in such a manner that the lower area of the lower case is covered, a water outlet is provided on the bottom wall of the lower cover, a tapered area is inclined downward to the water outlet, and thus any water that leaks into the inside of electric junction box is surely discharged.

A bus bar mounted area of which an upper surface is made flat may protrude in a step-wise form. A first connecting claw may be provided around a surrounding wall of the lower case within a gap provided in the upper surface, and a second connecting claw which connects with the first connecting claw may be provided on the bus bar itself. However, the position of the connecting claws is not limited to a curved area deflected from the outside.

A fuse may be mounted on the upper surface of the bus bar. The fuse may be fastened with a nut buried in the lower case through a through-hole formed on the bus bar, and the bus bar may be held between a fuse and the lower case by the fastening. As mentioned above, when mounting a fuse, holding and fastening the bus bar by a fastening effect that fixes the fuse to the lower case can further strengthen the fixing force for the bus bar.

A housing area for a relay, fuse, etc. provided in the conventional upper case may protrude from the upper surface of the lower case, and incorporates a relay, fuse, etc. in the housing area.

According to another aspect of the present invention, there is provided an electric junction box structured to house a bus bar, comprising an upper cover, a lower cover, a lower case defining a mounting surface for the bus bar, the lower case including a first locking surface extending from the mounting surface to engage the upper cover, and a second locking surface extending opposite from the first locking surface to engage the lower cover.

According to still another embodiment of the present invention, there is provided a method for mounting a bus bar within a junction box. The method includes mounting and locking a bus bar into a bus bar mounting area of a lower case, attaching a first hook portion of the lower case to an upper cover that covers the bus bar while mounted on the bus bar mounting area, and attaching a first hook portion of the lower case to a lower cover opposite the upper cover.

According to yet another aspect of the present invention, there is provided a method for mounting a bus bar within an electric junction box. The method includes mounting a bus bar onto a bus bar mounting area of a lower case, attaching a lower cover to the lower case, and attaching an upper cover directly to the lower case without the use of an upper case such that a top surface of the bus bar openly communicates with an inside surface of the upper cover.

These and other salient features of the invention will become apparent from or described with reference to the following detailed description of preferred embodiments.

BRIEF DESCRIPTION OF THE DRAWINGS

The invention will be described with reference to the following drawings in which.

DETAILED DESCRIPTION OF PREFERRED EMBODIMENTS

Description of preferred embodiments of the present invention follows below with reference to FIGS. 1 to 3.

Figure 1:
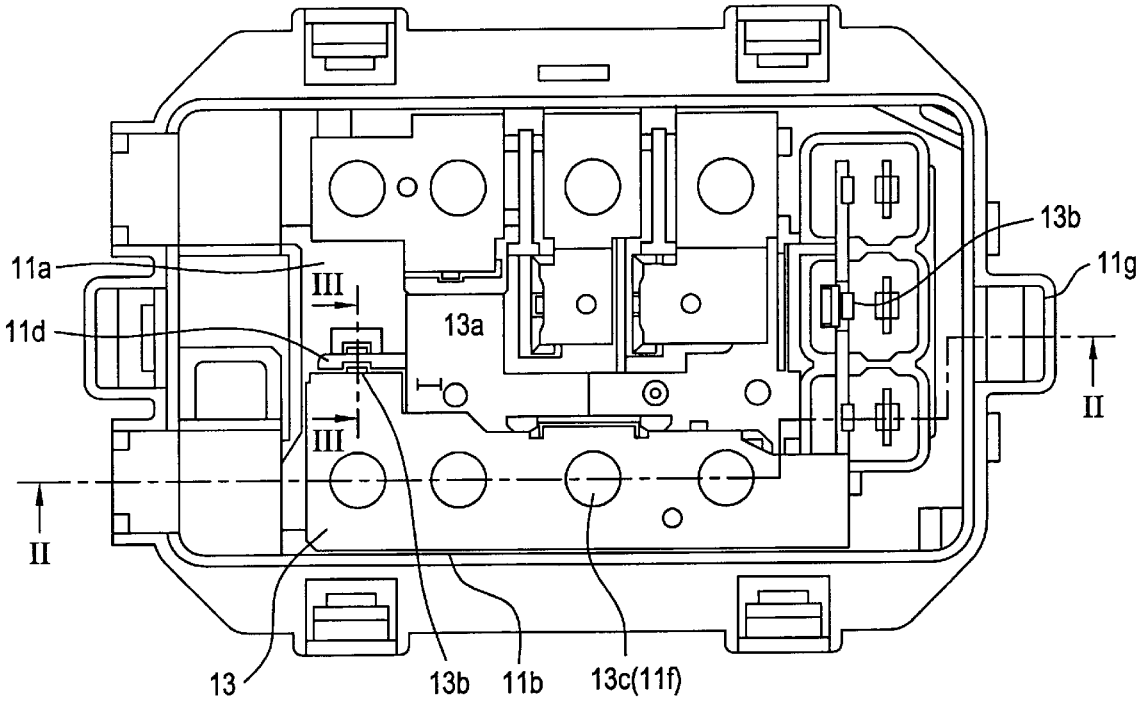
FIG. 1 illustrates a plan view in which an upper cover is eliminated on an electric junction box relating to the embodiment of the present invention.
Figure 2:
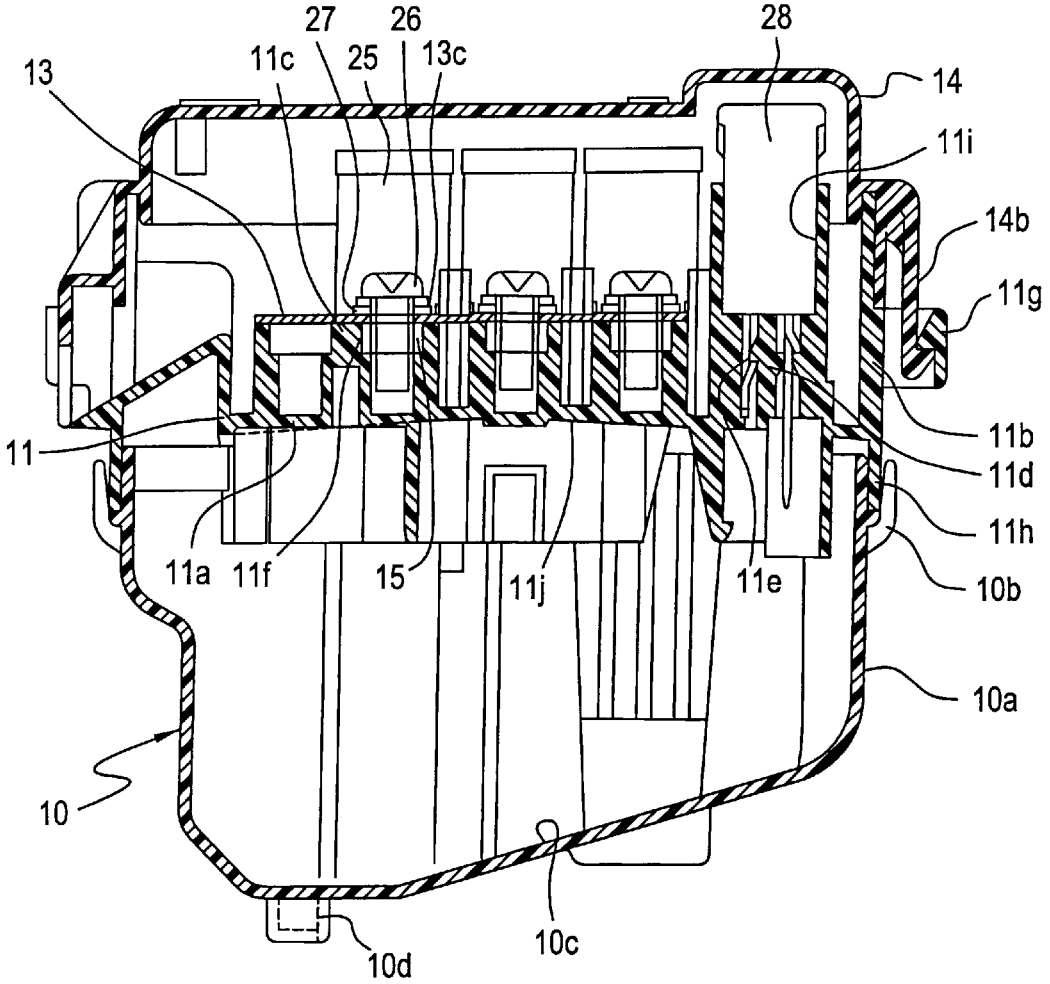
FIG. 2 illustrates a sectional view II—II of FIG. 1.
Figure 3:
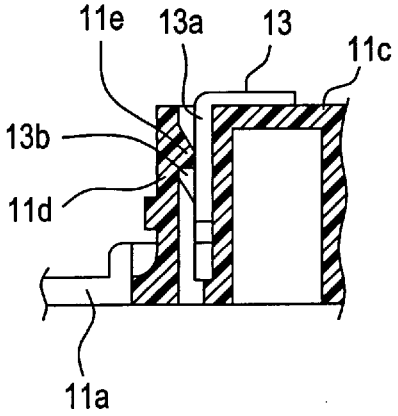
FIG. 3 illustrates a sectional view III—III of FIG. 1.
Figure 4:
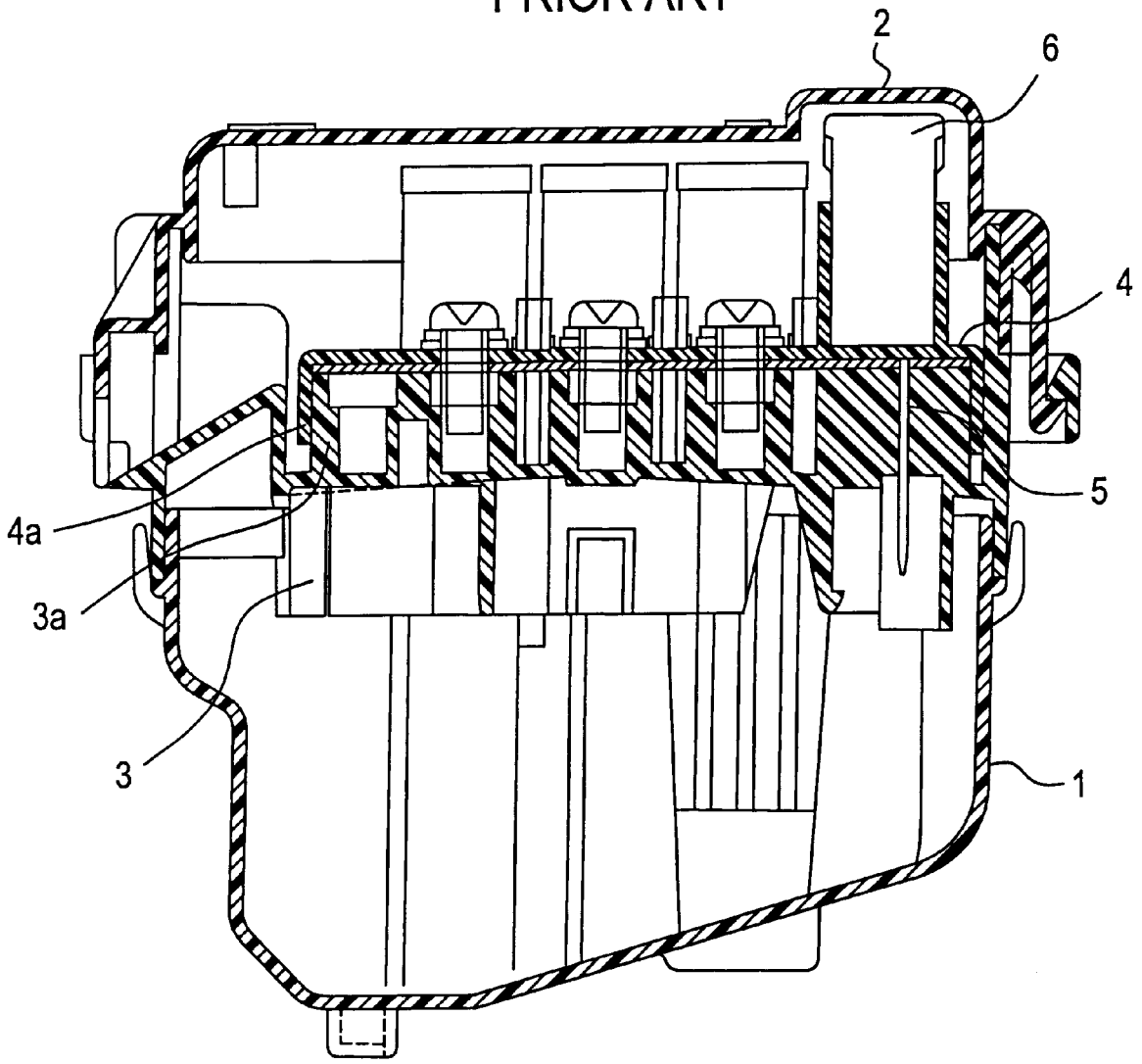
Fig. 4 PRIOR ART
FIG. 4 illustrates a sectional view of the conventional electric junction box.

FIGS. 1 and 2 show a lower cover 10, a lower case 11, a bus bar 13, and an upper cover 14. As is apparent from the comparison between FIGS. 4 and 2, the upper case conventionally provided is eliminated.

In FIG. 2, the lower case 11 includes an external surrounding area 11*b* extending in both upward and downward directions to the surrounding edge of a main body area 11*a* that has a substantially rectangular horizontal board. A bus bar mounting area 11*c*, which has an upper surface oriented horizontally, is formed in several spaced portions in a step-wise protruded manner on the upper area of the main body 11*a*. A gap is provided at a predetermined position on the surrounding wall of the bus bar mounting area 11*c*. Connecting wall areas 11*d* are provided in a stepwise protruded manner adjacent each other, and a connecting claw 11*e* is provided in a step-wise protruded manner on the connecting wall area 11*d*, as shown in FIG. 3. Likewise, a bolt hole 11*f* is provided on the upper surface opening on the bus bar mounting area 11*c*, and a nut 15 is embedded within the bolt mounting hole.

A lock area 11*g* that cooperates with an upper cover 14 is provided on the upper area of the external surrounding wall 11*b* of lower case 11 while a lock area 11*h* cooperable with a lower cover 10 is provided on the lower area. In addition, a fusible link housing area 11*i* extends upwardly in a protruded manner on a part of the main body 11*a*, and a lower surface 11*j* of the main body 11*a* is inclined downward to the external surrounding so that any water may flow down to the lower cover 10 even if water leaks occur.

On the bus bar 13, which includes an electroconductive metal plate mounted on the horizontal upper surface of the bus bar mounting area 11*c*, a curved area 13*a* deflected downward to a position opposite to a location with the connecting wall area 11*c* is provided, which forms a connecting claw 13*b* on the curved area 13*a*. The curved area 13*a* is inserted between an external surface of the bus bar mounting area 11*c* and connecting wall area 11*e*, and the bus bar 13 is directly fixed onto the lower case 11 by making the connecting claw 13*b* connect with the connecting claw 11*e*.

Furthermore, a bolt through-hole 13*c* is provided on a position which opens up to a bolt mounting hole 11*f* provided on the lower case 11. A fuse 25 is mounted on the upper surface of bus bar 13, and a bolt 26 to fix the fuse 25 is fastened with a nut 15 through the bolt through-hole 13*c* and a bolt mounting hole 11*f*. The bus bar 13 is held and positioned between a washer 27 for the lower surface of the bolt 26 and a bus bar mounting area 11*d*.

The upper cover 14 mounts the bus bar 13 and fuse 25 on the lower case 11, and, in a condition that a fusible link 28 is incorporated in a fusible link housing area 11*i*, is mounted on the lower case 11 as if it covers them. That is, on the lower end of the surrounding wall 14*a* of upper cover 14, a locked area 14*b* is provided that connects with a locking area 11*g* of the lower case 11.

In the same way, a locked area 10*b* that connects with a lock area 11*h* of the lower case 11 is mounted on the upper edge area of the surrounding wall 10*a* of lower cover 10. Furthermore, a water discharge hole 10*d* is provided on a bottom wall 10*c* of the lower case 10, the bottom wall 10*c* being inclined downward to the water discharge hole 10*d* so that water leaking in the inside of electric junction box flows towards the water discharged hole 10*d* and then the leaking water is discharged from the discharge hole 10*d*.

With the electric junction box having the abovementioned structure, a bus bar 13 is mounted on the upper surface of bus bar mounting area 11*c* of lower case 11, the curved area 13*a* is inserted into a gap between the bus bar mounting area 11*c* and connecting wall area 11*d*, the connecting claw 13*b* contacts with the connecting claw 11*e*, and the bus bar 13 directly faces the lower case 11. In addition, a fuse 25 is mounted on the bus bar 13, by fastening a bolt 26 with a nut 15 through a bolt through-hole 13*a* of the bus bar 13 and a bolt mounting hole 11*f* of lower case 11, a fuse 25 can be fixed with lower case 11 and the bus bar 13 can also be held between a washer 27 for bolt 26 and the lower case 11. In this way, because the bus bar can directly connect with the lower case and is held by using a fixing action to the lower case 11 of the fuse 25, firm fastening can be assured without holding the bus bar between the lower case and the upper case as has theretofore been carried out.

With the lower case, necessary components are mounted by incorporating fusible ring 28 in a fusible ring housing area 11*i* provided on the upper surface, etc. Then, assembling is made by locking a lower cover 10 and upper cover 14 onto the lower case 11 for completing the electric junction box.

As is apparent from the description above, the structure as has conventionally been adopted is that an upper case and a lower case are locked and fastened by covering the upper case with the bus bar mounted on the upper surface of lower case. With the electric junction box of the present invention, the use of an upper case becomes unnecessary with such a structure that directly fastens the bus bar to the lower case. Therefore, the number of components used and consequently production costs can be reduced, which makes the electric junction box smaller in size and lighter in weight. In addition, because a process for mounting the upper case can be eliminated, the number of assembly processes can also be reduced, thereby also reducing the production cost.

The invention has been described in detail with respect to preferred embodiments thereof, which are intended to be illustrative, not limiting. Various modifications can be made without departing from the spirit and scope of the present invention as defined in the appended claims.

What is claimed is:

1. An electric junction box incorporating a bus bar comprising:

a first locking area formed as an integral portion on the bus bar;

a second locking area provided on a lower case, said second locking area being lockable with said first locking area, wherein the first locking area is connected and locked with the second locking area;

an upper cover attachable to said lower case to cover said bus bar arranged on an upper surface of the lower case; and a fuse mounted on and contiguous with an upper surface of the bus bar, said bus bar being held and fastened between said fuse and the lower case by fastening a bolt which penetrates through a through-hole provided in said bus bar with a nut embedded in the lower case.

2. The electric junction box according to claim 1, flier comprising a lower cover attached on a lower area of the lower case.

3. The electric junction box according to claim 1, further comprising a bus bar mounting area on the upper surface of the lower case formed by a plurality of spaced portions protruding in a stepped manner on the upper surface of the lower case, wherein the second locking area comprises a connecting claw provided on a surrounding wall of a connecting wall area provided on the lower case, and wherein the first locking area comprises a connecting claw formed on the bus bar which is connected with the connecting claw of the lower case.

4. An electric junction box structured to house a bus bar, comprising:

an upper cover;

a lower cover;

a lower case defining a mounting surface for said bus bar, said lower case including a first locking surface extending from said mounting surface to engage said upper cover, and a second locking surface extending opposite from said first locking surface to engage said lower cover; and a fuse contiguous with the bus bar and connected to said mounting surface of the lower case, wherein said bus bar includes a bent portion that protrudes into a space provided in said mounting surface of said lower case and below said fuse.

5. The electric junction box according to claim 4, further comprising a first connecting claw extending from said bus bar and a second connecting claw extending from a connecting wall area of said lower case, said first and second connecting claws cooperating to lock said bus bar relative to said mounting surface of said lower case.

6. The electric junction box according to claim 4, wherein said upper cover is not associated with an upper case.

7. The electric junction box according to claim 4, further comprising an inclined surface formed as part of said lower cover, said inclined surface being structured to guide water from an inside of the lower cover to a water discharge hole provided adjacent said inclined surface.

8. The electric junction box according to claim 4, wherein said bent portion of said bus bar and said space in said mounting surface include cooperating locking claws.

9. A method for mounting a bus bar within an electric junction box, comprising:

mounting and locking a bus bar onto a bus bar mounting surface of a lower case;

attaching a first locking surface extending from said mounting surface of said lower case to an upper cover that covers the bus bar while mounted on the bus bar mounting area;

attaching a second locking surface extending opposite from the first locking surface to a lower cover opposite said upper cover;

providing a fuse contiguous with the bus bar and connecting the fuse to the mounting surface of the lower case; and providing the bus bar with a bent portion that protrudes into a space provided in said mounting surface of the lower case and below the fuse.

10. The method according to claim 9, further comprising engaging matched locking claws of the bus bar and the bus bar mounting surface to each other.

11. The method according to claim 9, further comprising:

mounting a fuse on the bus bar mounting area; and holding and fastening said bus bar between said fuse and the lower case by fastening a bolt which penetrates through a through-hole provided in said bus bar with a nut embedded in the lower case.

12. The electric junction box according to claim 4, further comprising a fusible link housing area extending from said mounting surface, said fusible link housing area supporting a fusible link.

* * * * *